US008979222B2

(12) United States Patent
Jahrling et al.

(10) Patent No.: US 8,979,222 B2
(45) Date of Patent: Mar. 17, 2015

(54) PULL-OUT GUIDE OF A DRAWER

(75) Inventors: Peter Jahrling, Bunde (DE); Alexander Hemminger, Halle (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 147 days.

(21) Appl. No.: 13/522,416

(22) PCT Filed: Feb. 1, 2011

(86) PCT No.: PCT/EP2011/051381

§ 371 (c)(1),
(2), (4) Date: Jul. 16, 2012

(87) PCT Pub. No.: WO2011/095476

PCT Pub. Date: Aug. 11, 2011

(65) Prior Publication Data

US 2012/0288221 A1 Nov. 15, 2012

(30) Foreign Application Priority Data

Feb. 2, 2010 (DE) ..... 10 2010 000 279

(51) Int. Cl.
*A47B 88/04* (2006.01)

(52) U.S. Cl.
CPC ..... *A47B 88/044* (2013.01); *A47B 88/0481* (2013.01)
USPC ..... 312/333; 312/334.8

(58) Field of Classification Search
USPC ..... 312/330.1, 333, 334.1, 334.7, 334.8, 312/334.44, 319.1, 401, 402, 404
See application file for complete search history.

(56) References Cited

U.S. PATENT DOCUMENTS

| | | | | |
|---|---|---|---|---|
| 3,918,752 | A * | 11/1975 | Leone et al. | 292/174 |
| 5,597,220 | A | 1/1997 | Domenig et al. | |
| 6,340,078 | B1 * | 1/2002 | Scheible | 188/166 |
| 6,736,471 | B2 * | 5/2004 | Lin | 312/333 |
| 6,846,053 | B2 * | 1/2005 | Salice | 312/334.14 |
| 2004/0056573 | A1 | 3/2004 | Chae | |
| 2004/0174101 | A1 * | 9/2004 | Lin | 312/333 |
| 2007/0046159 | A1 * | 3/2007 | Hoffman | 312/333 |
| 2007/0126324 | A1 * | 6/2007 | Lee | 312/402 |
| 2008/0231153 | A1 * | 9/2008 | Cho | 312/333 |

FOREIGN PATENT DOCUMENTS

| | | |
|---|---|---|
| DE | 20 2006 019 009 | 5/2008 |
| DE | 10 2008 014 871 | 9/2009 |
| DE | 20 2008 008 121 | 12/2009 |
| DE | 10 2008 031 462 | 1/2010 |
| WO | 2010/011822 | 1/2010 |

OTHER PUBLICATIONS

German Search Report corresponding to Application No. DE 10 2010 000 279.8 dated Feb. 2, 2010.

* cited by examiner

*Primary Examiner* — James O Hansen
(74) *Attorney, Agent, or Firm* — Barnes & Thornburg LLP

(57) ABSTRACT

A pull-out guide of a movable element of a piece of furniture or a domestic appliance. The pull-out guide including a guide rail configured to be fixed to a body of the piece of furniture or domestic appliance; a movable element; and a slide rail configured to be connected to the movable element. The guide rail is detachably connected to a molded part, the molded part being provided on the body. A component is configured to support movement of the movable element.

18 Claims, 11 Drawing Sheets

PULL-OUT GUIDE OF A DRAWER

This application is a national stage of International Application PCT/EP2011/051381, filed Feb. 1, 2011, and claims benefit of and priority to German Patent Application No. 10 2010 000 279.8, filed Feb. 2, 2010, the content of which Applications are incorporated by reference herein.

BACKGROUND AND SUMMARY

The present disclosure relates to a pull-out guide of a movable element of a piece of furniture or a domestic appliance, for example, a refrigerating appliance. The pull-out guide includes a guide rail configured to be fixed to a body of the piece of furniture or domestic appliance; a movable element; and a slide rail configured to be connected to the movable element. The guide rail is detachably connected to a molded part, the molded part being provided on the body.

Generic pull-out guides for movable elements, especially drawers, are known in various embodiments. WO2010/011822 discloses a control apparatus for a pull-out guide in which a rail is movably held by rollers on a guide rail, with a damping device being provided for braking a closing movement.

As in DE 202008008121 U1, a guide rail of the pull-out guide is usually fixed in a conventional pull-out guide to one or two supporting molded parts provided on the body of the domestic appliance. Frequently, components supporting a pull-out and/or retraction movement of the drawer, such as an automatic retraction device or an ejection apparatus, are mounted on the pull-out guide for supporting the operation.

The use of such conventional pull-out guides is possible in many applications. In special applications, however, such as in freezers or refrigerators, these pull-out guides are less suitable for reasons of space and/or hygiene.

The one or more embodiments of the present disclosure provide for a pull-out guide of a movable element of a piece of furniture or a domestic appliance which are configured to be mounted in an especially compact and hygienically compatible manner in the body of the piece of furniture or domestic appliance.

Thus, as suggested above, embodiments of the present disclosure relate to a pull-out guide of a movable element of a piece of furniture or a domestic appliance. The pull-out guide includes a guide rail configured to be fixed to a body of the piece of furniture or domestic appliance; a movable element; and a slide rail configured to be connected to the movable element. The guide rail is detachably connected to a molded part, the molded part being provided on the body. A component is configured to support movement of the movable element. The component is fixed to the molded part above the slide rail perpendicularly to a pull-out direction of the pull-out guide.

The component supporting the pull-out and/or retraction movement of the movable element is fastened to the molded part perpendicularly to the pull-out direction above the slide rail.

By placing the component above the slide rail, the horizontal extension of the pull-out guide is reduced substantially, on the one hand, so that the width of the piece of furniture or domestic appliance can be utilized optimally for the movable elements. On the other hand, by placing the component supporting the pull-out and/or retraction movement of the movable element above the slide rail of the pull-out guide it is ensured that virtually no dirt can penetrate the component.

Additional advantageous features of embodiments of the present disclosure are found herein, including the claims.

In accordance with one embodiment of the present disclosure, an activator arranged in the slide rail for controlling the component supporting the pull-out and/or retraction movement of the movable element engages into the component from below. Penetration of dirt into this component is, thereby, additionally effectively prevented.

In accordance with a further embodiment of the of the present disclosure, the component supporting the pull-out and/or retraction movement of the movable element is covered at least from above with a protective cover.

In accordance with a further embodiment of the present disclosure, the activator is integrally produced with an end stopper sealing the front face side of the slide rail. As a result, welding the activator to the slide rail is no longer required. That would be difficult in planned usage of the pull-out guide for freezers or refrigerators because these pull-out guides require an increased zinc coating for improving protection from corrosion.

In accordance with a further embodiment of the present disclosure, two mutually facing spring elements are formed on the component supporting the pull-out and/or retraction movement of the movable element, which spring elements engage behind an upper end of the molded part.

The movable element is configured to be arranged as pull-out shelves, apothecary pull-outs, larder-unit pull-outs or drawers. Other arrangements of the movable element are within the scope of the present disclosure.

Other aspects of the present disclosure will become apparent from the following descriptions when considered in conjunction with the accompanying drawings.

DETAILED DESCRIPTION

In the following description, the terms such as top, bottom, left, right, front, back, for example, relate exclusively to exemplary illustrations and position of the pull-out guide and other elements as shown in the respective drawings. These terms shall not be understood as limiting, which means that these references can change through various working positions or a mirror-symmetric configuration, for example.

Figure 1:
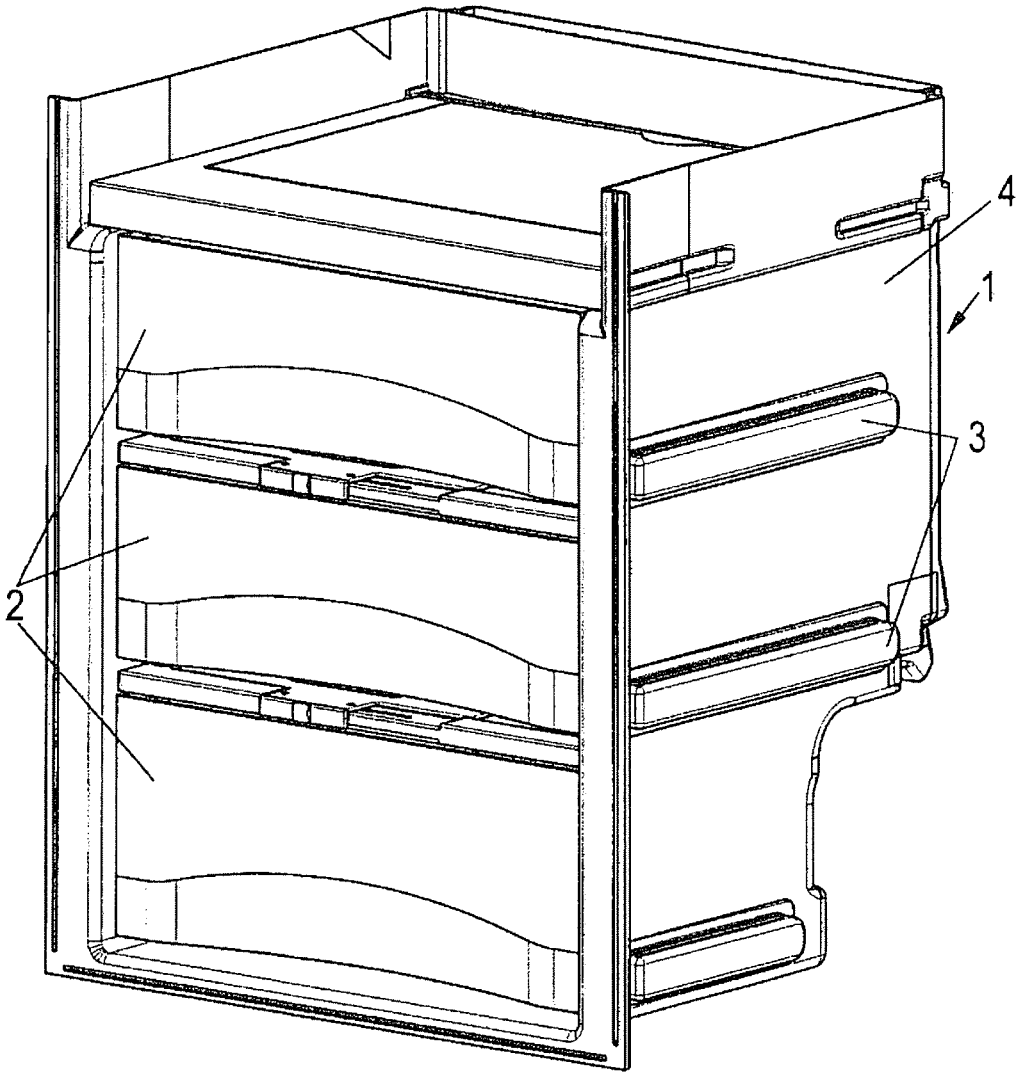
FIG. 1 shows a perspective view of a body of a domestic appliance arranged, for example, as a refrigerator and without showing the outside walls, in accordance with the present disclosure.
Figure 2:
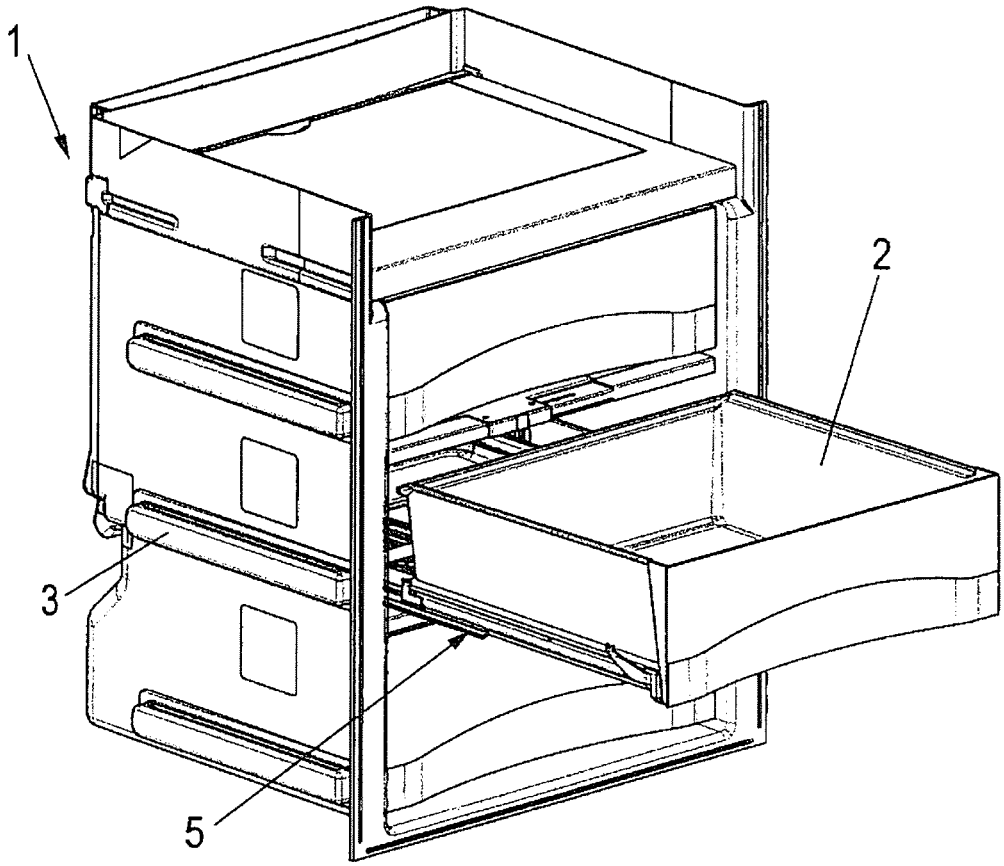
FIG. 2 shows a perspective view of the body of FIG. 1 with a drawer in an extended position.
Figure 3:
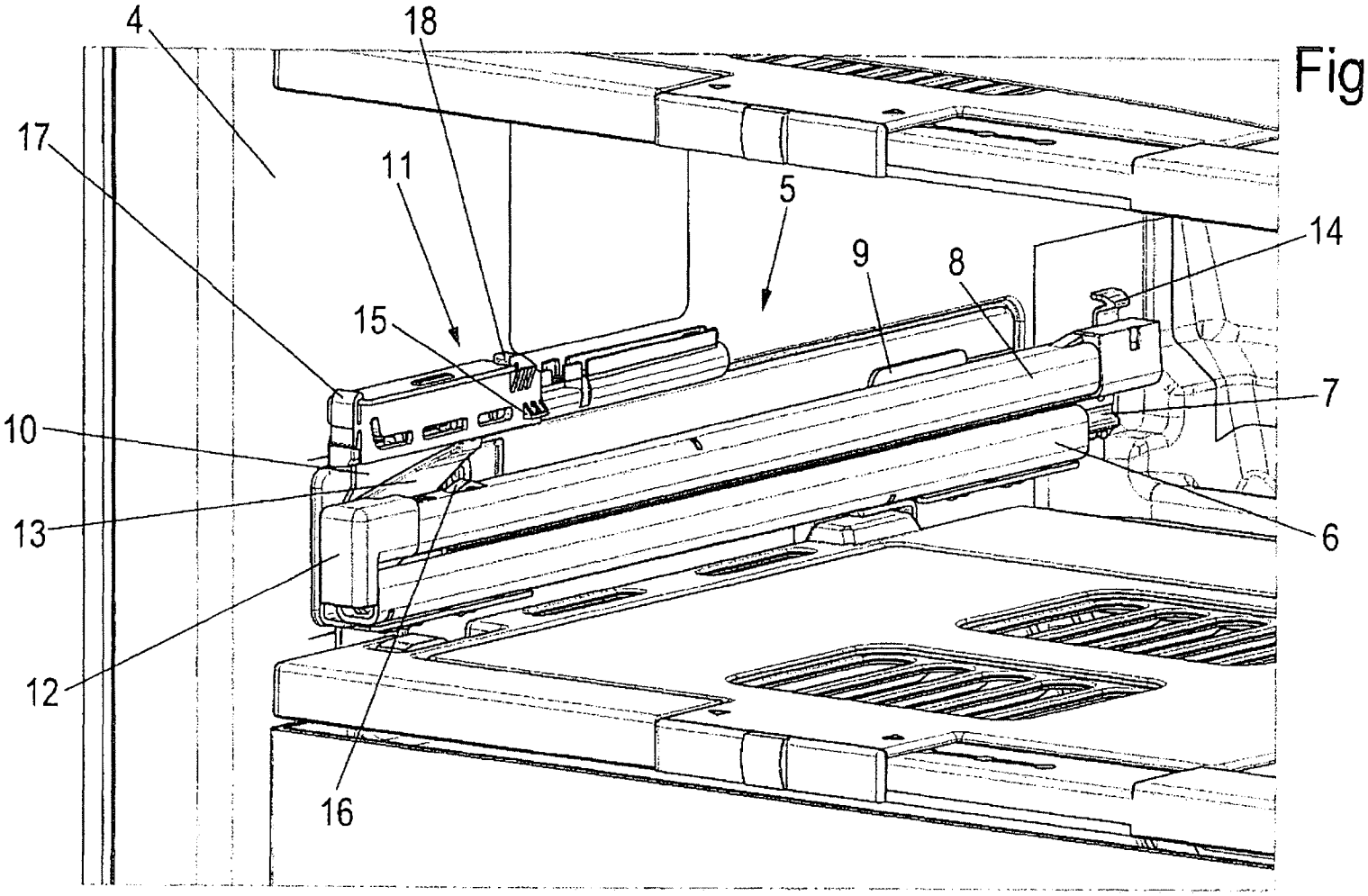
FIG. 3 shows a perspective view of an embodiment of a pull-out guide in accordance with the present disclosure, the pull-out guide being installed in the refrigerator body, in accordance with the present disclosure.
Figure 4:
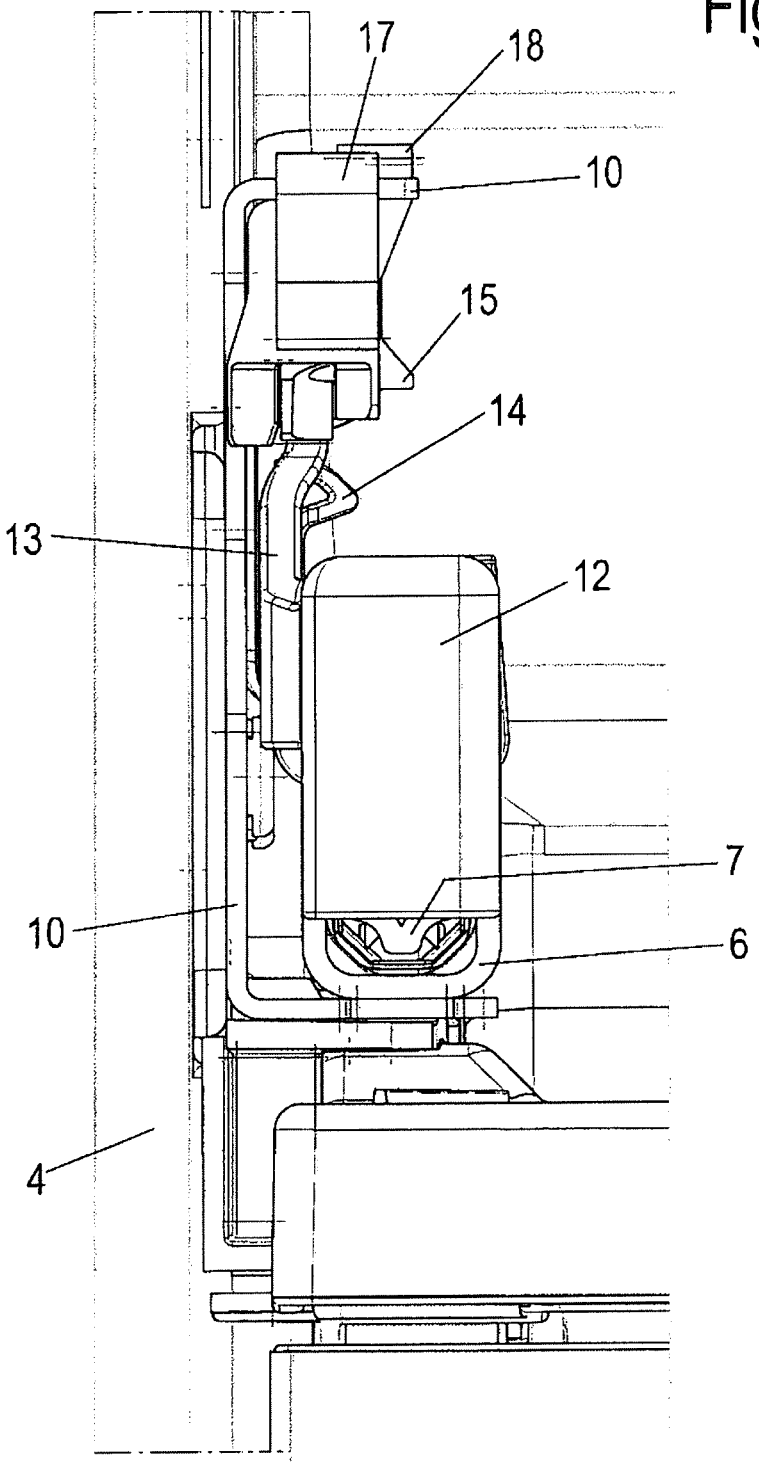
FIG. 4 shows a front view of the pull-out guide of FIG. 3.

FIGS. 1 and 2 show a domestic appliance 1, for example, a refrigerating appliance, such as a freezer, for example. The outer insulating walls of the freezer are not shown. The appliance includes three drawers 2 in the shown embodiment. Outwardly protruding receivers 3 are formed on a body or side walls 4 of the appliance for accommodating pull-out guides 5.

As is shown in FIGS. 3 to 11, the pull-out guides 5 may include a guide rail 6 which is detachably fixed via two molded parts 9, 10 to the body 4 of the domestic appliance. A middle rail 7 is arranged in a known manner on which a slide rail 8 connected to the drawer 2 is displaceably arranged. Fixing of guide rails 6 to a single molded part 9, 10, which may be provided in a wider arrangement, is within the scope of the present disclosure.

The front molded part 10 is arranged, for example, in the shape of a C, with a bottom horizontal short limb of the molded part 10 supporting the guide rail 6 from below and the upper short limb of the molded part 10 being used for fixing a component 11 perpendicularly to a pull-out direction X above slide rail 8. The component 11 supports the pull-out and/or retraction movement of the drawer 2. For this purpose, two mutually facing spring elements 17, 18 are formed on a housing of the component 11, which spring elements 17, 18 engage behind an upper end 20 of the molded part 10. This is so that the upper end 20 of the molded part 10 is clamped between the main housing body and the spring elements 17, 18 and holds the component 11 in this way. An elevation 22 may, for example, be formed on the housing of the component 11 for aligning the component 11 by way of a fixed position. The elevation 22 protrudes into a groove 21 in the upper end 20 of the molded part 10 in the mounted state of the component 11.

The component 11 supporting the pull-out and/or retraction movement of the drawer 2 is arranged as an automatic retraction device, for example. It is within the scope of the present disclosure to provide an arrangement as an ejection apparatus or as a combination of an ejection apparatus with an automatic retraction device. In accordance with an embodiment of the present disclosure, the component 11, which supports the pull-out and/or retraction movement of the drawer 2, can, within the scope of the present disclosure also be arranged with a damping device for damping the ejection movement or the retraction movement of the drawer 2.

An end stopper 12 is provided at the front face end of the slide rails 8 for controlling the component 11. The end stopper 12 is provided with an integrally formed activator 13 for controlling the component 11. The activator 13 engages into a lever of the component 11 during the tensioning of a random energy storing device of the component 11. The lever is able to tilt to a position from a specific path of displacement in which the activator 13 can leave the lever. In this process, the lever is secured in its position and can only be moved back to its initial position again when the activator 13 comes into contact with the lever again when the slide rail 8 is pushed in and moves it from its blocking position. In a case of component 11 being arranged as an automatic retraction device, the force stored in the energy storing device of the automatic retraction device will be used to retract the slide rail 8 and, therefore, the connected drawer 2 back to its final retracted position.

Figure 5:
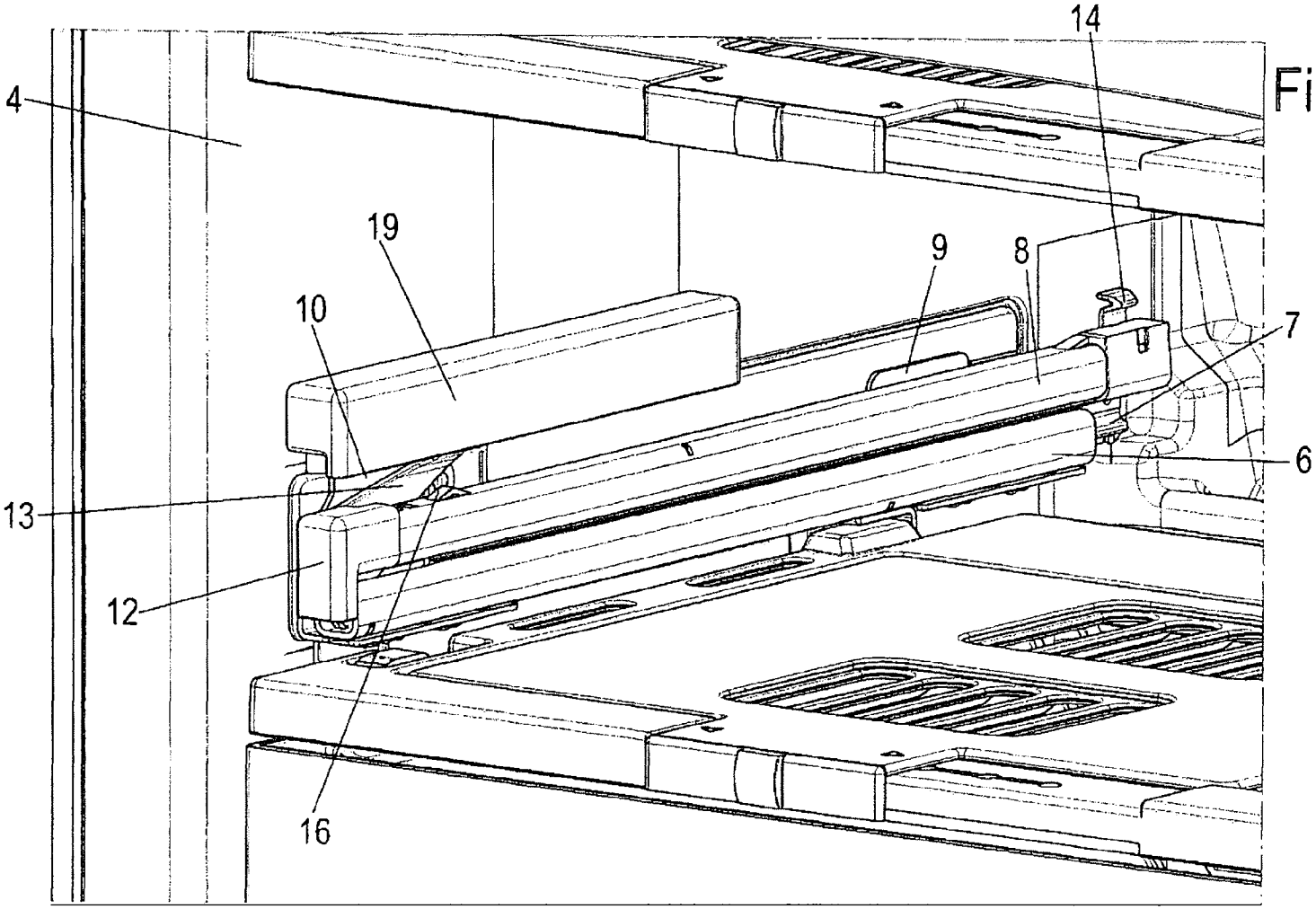
FIG. 5 shows a perspective view of the pull-out guide of FIG. 4 built into the body and with an installed protective cover, in accordance with the present disclosure.
Figure 6:
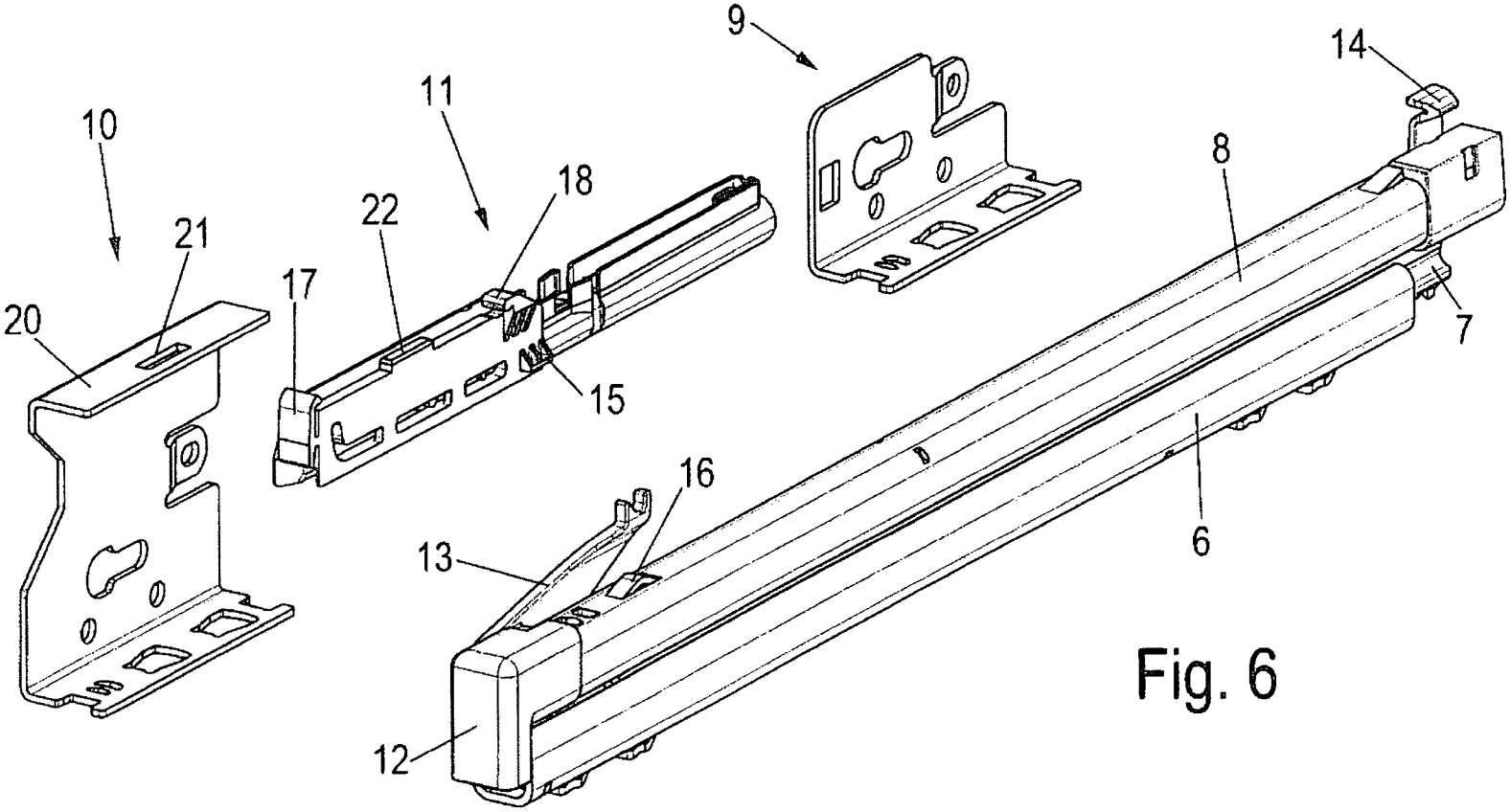
FIG. 6 shows a perspective exploded view of an embodiment of the pull-out guide, in accordance with the present disclosure.
Figure 7:
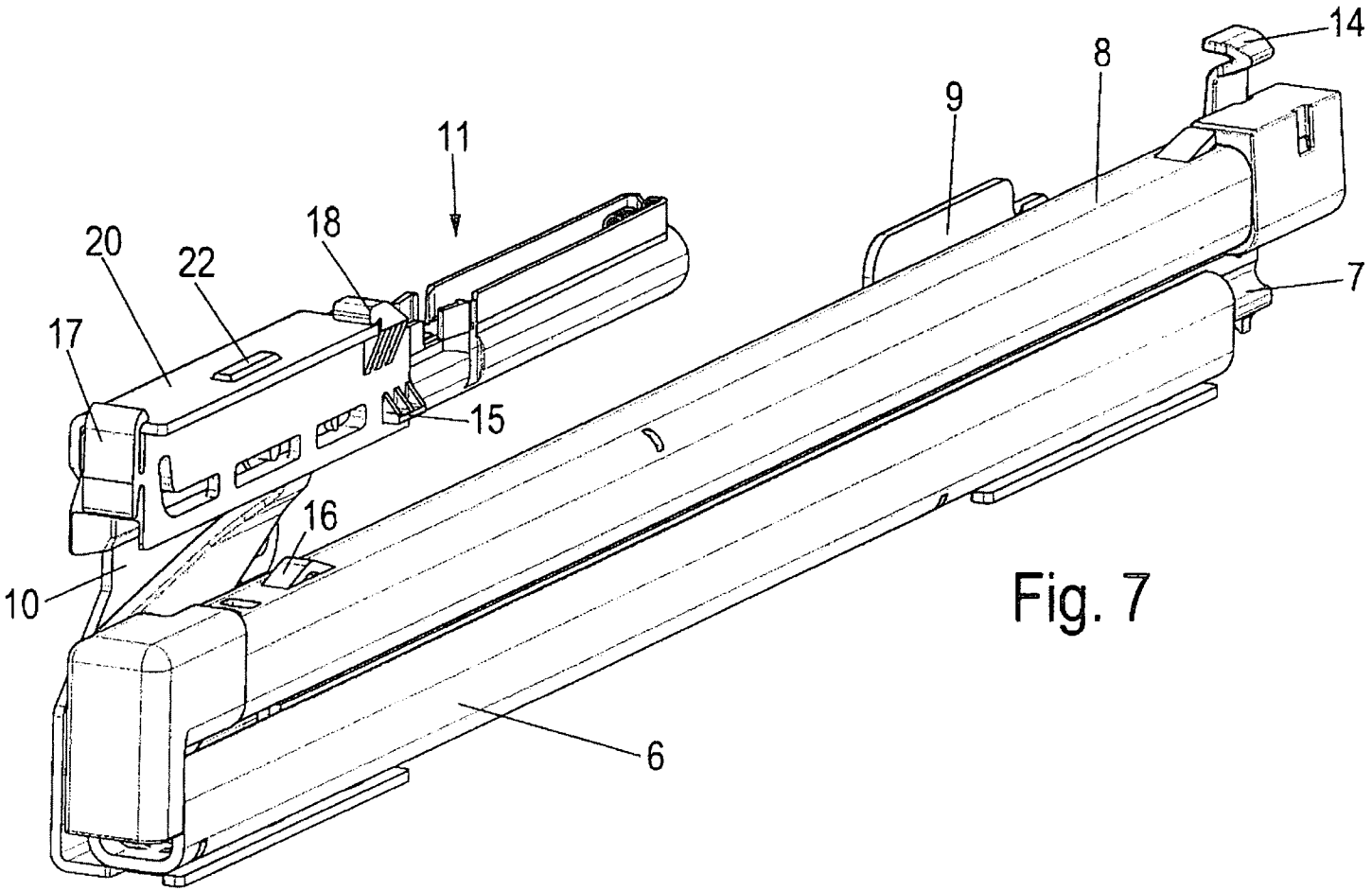
FIGS. 7 and 8 show perspective views of an embodiment of a pull-out guide with and without a protective cover, in accordance with the present disclosure.
Figure 8:
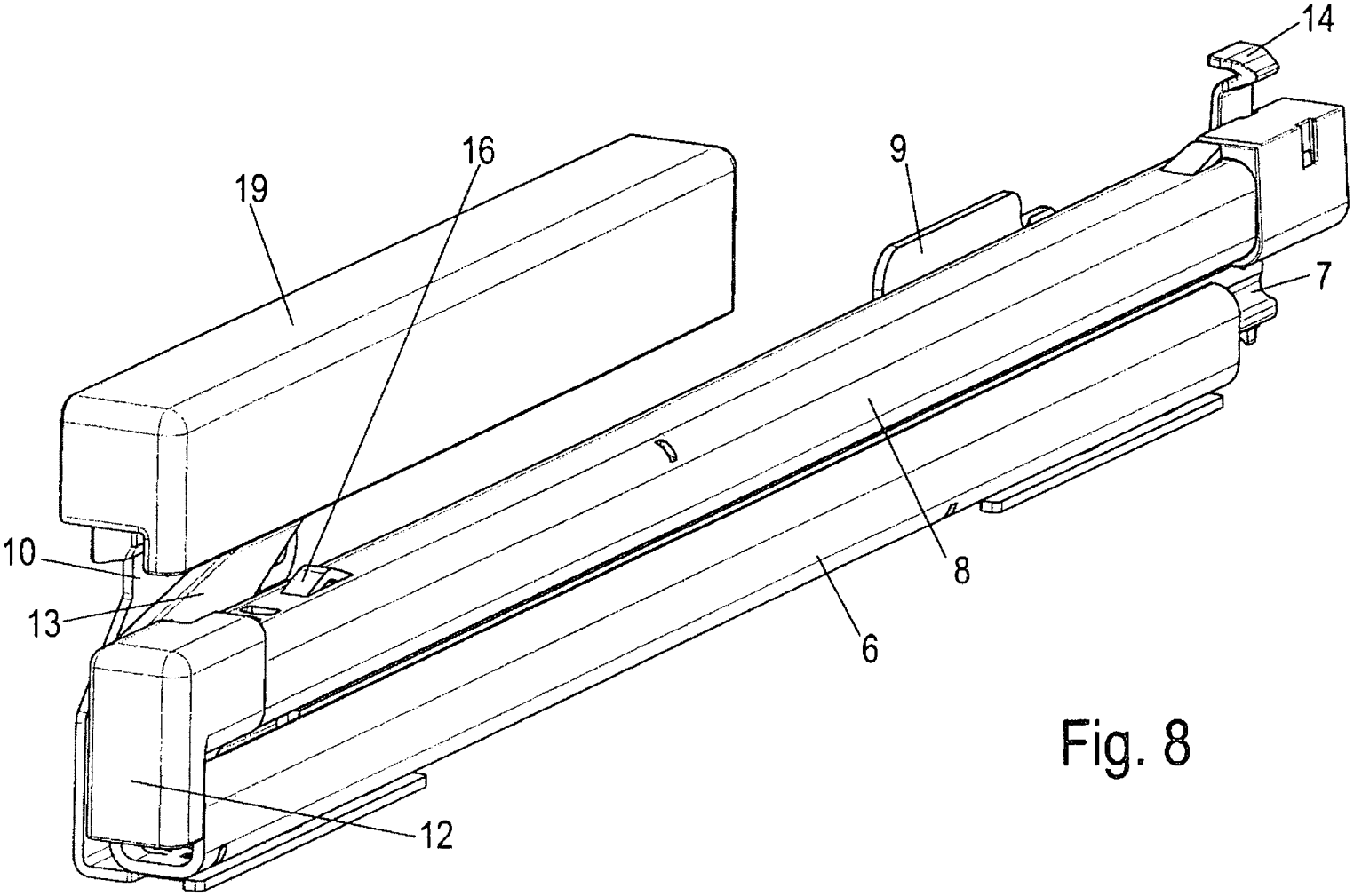
Figure 9:
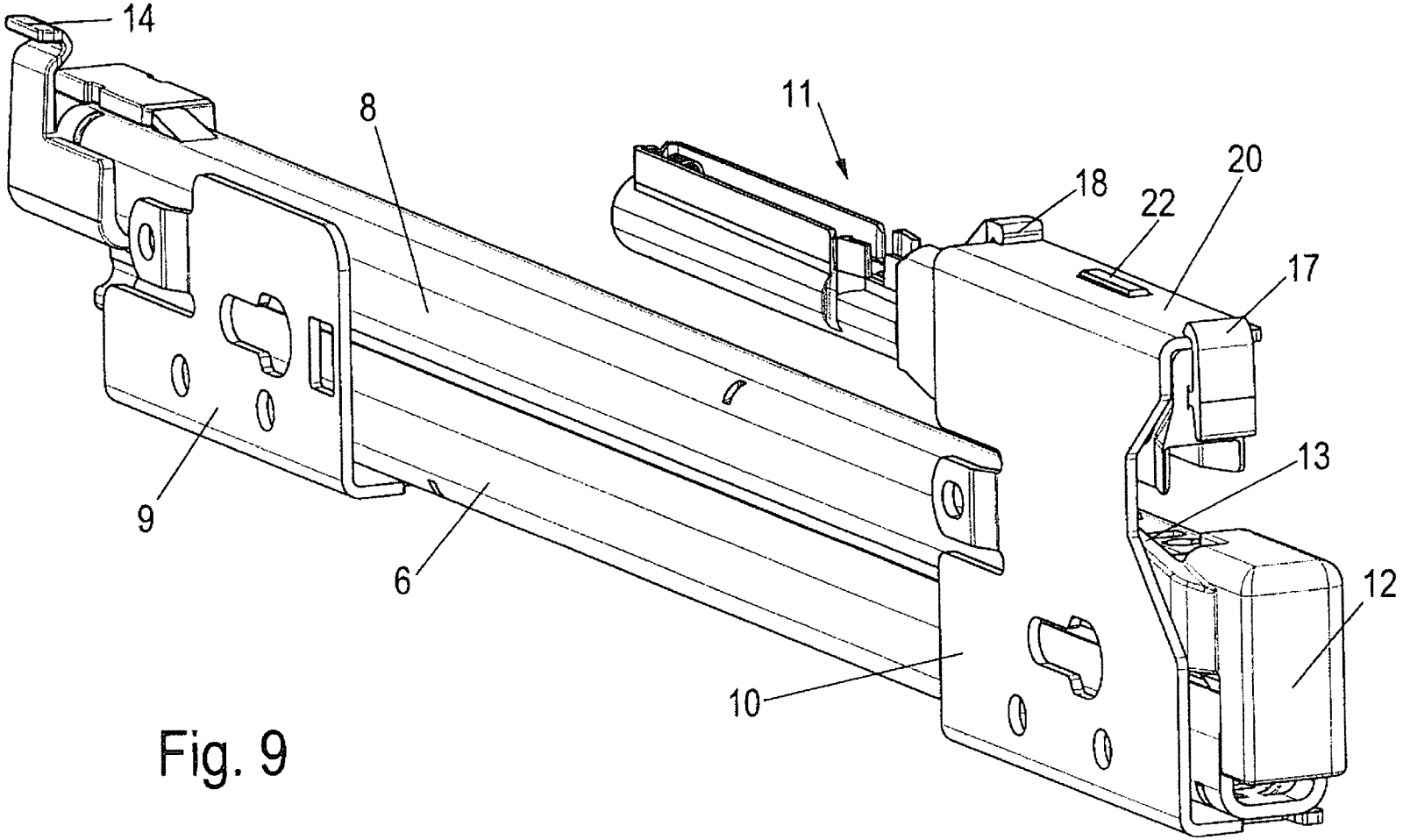
FIG. 9 shows a further perspective view of an embodiment of a pull-out guide from a rear perspective, in accordance with the present disclosure.
Figure 10:
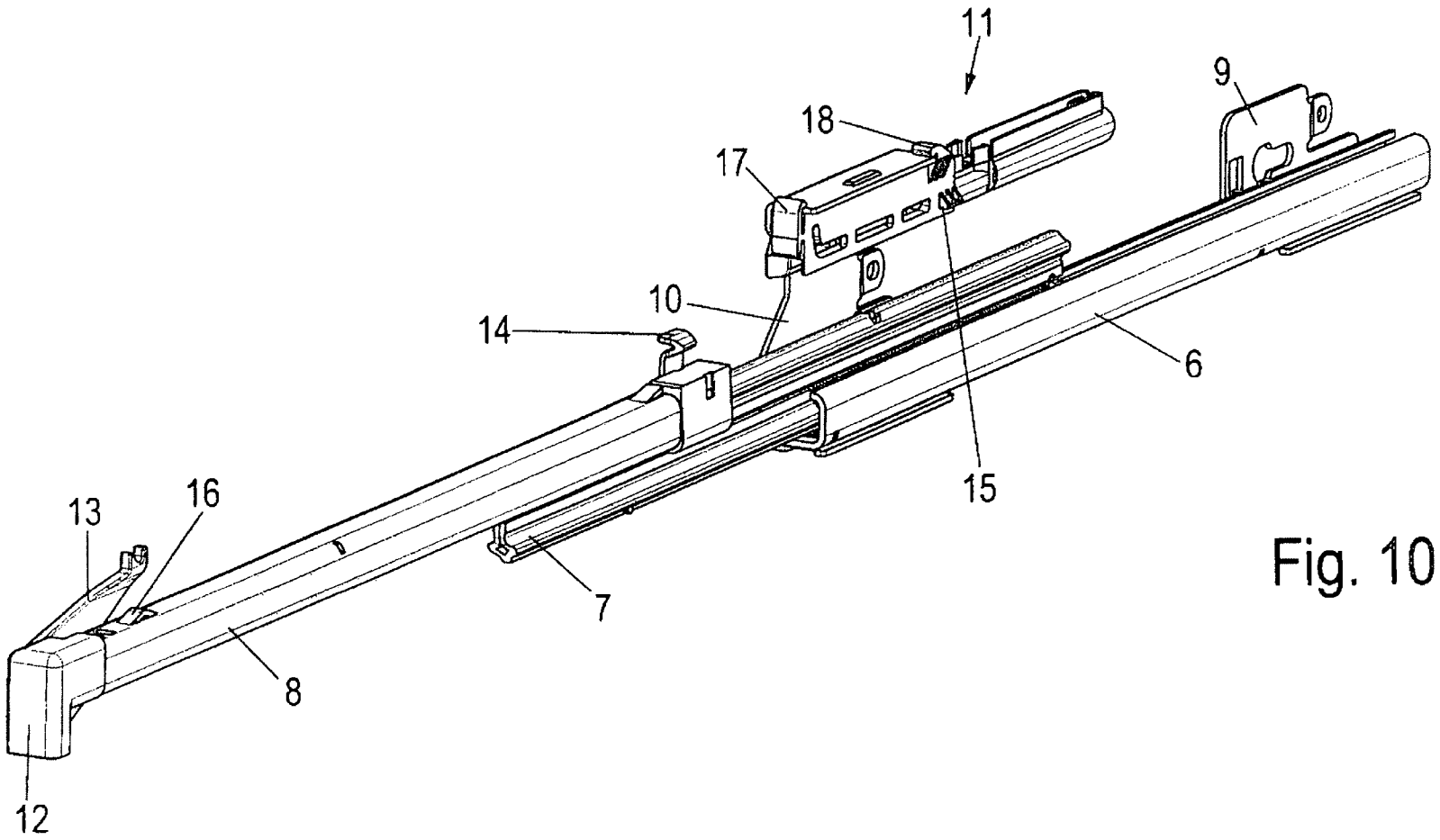
FIGS. 10 and 11 show perspective views of a pull-out guide in an extended state, in accordance with the present disclosure.
Figure 11:
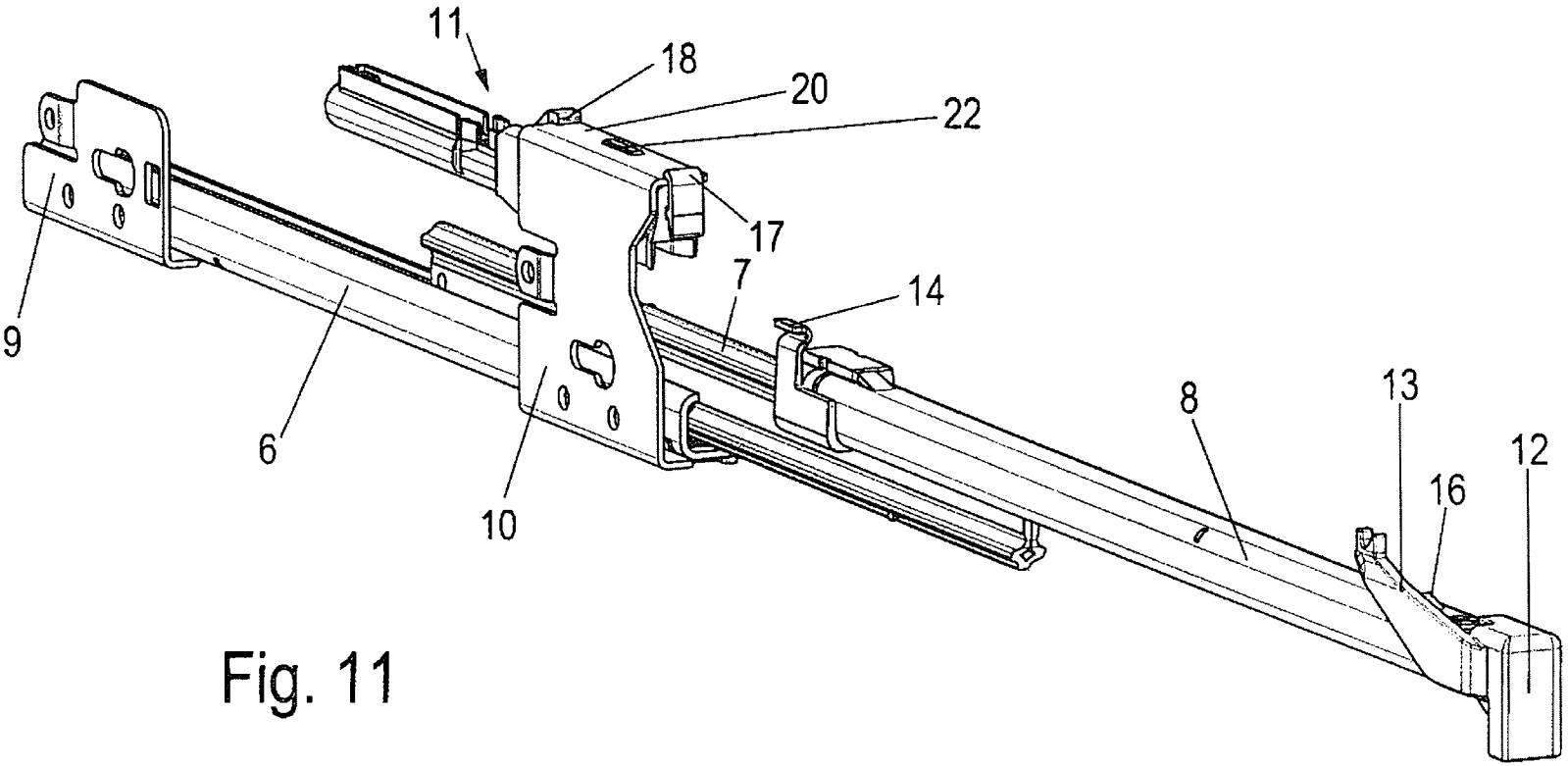

It is advantageous that the activator 13 engages from below into the component 11, so that the functionality of the component 11 cannot be impaired by dirt falling into the component 11. In order to protect openings provided on the housing of component 11 from the penetration of dirt, the component 11 is covered at least from the top, but, for example, also from the top, left and right, with a protective cover 19, as shown in FIG. 5, for example.

In order to lock the drawer 2 on the slide rail 8, a protrusion 15 with a spring element 14 may, for example, be provided at the rear end of the slide rail 8, with which a bottom outer edge of the drawer 2 can be tightly clamped. A nose 16 is provided on the upper side of the slide rail 8 for the purpose of locking the drawer edge in the front region of the slide rail 8, which nose 16 clamps the outer edge of the drawer 2 together with a protrusion 15 protruding on the housing of the component 11 in the direction of the drawer 2.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A pull-out guide of a movable element of a piece of furniture or a domestic appliance, the pull-out guide comprising:

a guide rail configured to be fixed to a body of the piece of furniture or domestic appliance;

a slide rail configured to be connected to the movable element;

the guide rail being detachably fixed to a molded part, the molded part being provided on the body;

a component configured to support movement of the movable element; and an activator arranged on the slide rail for controlling the component;

wherein the activator is arranged integrally with an end stopper sealing a front face side of the slide rail;

wherein the component is fixed to the molded part above both the guide rail and the slide rail perpendicularly to a pull-out direction of the pull-out guide; and wherein the activator engages from below into the component.

2. The pull-out guide according to claim 1, wherein the component is configured as one or both of an automatic retraction device and an ejection apparatus.

3. The pull-out guide according to claim 2, wherein the component is arranged with a damping device.

4. The pull-out guide according to claim 1, wherein the component is covered at least from above by a protective cover.

5. The pull-out guide according to claim 1, wherein the component is latched onto the molded part.

6. The pull-out guide according to claim 1, wherein two mutually facing spring elements are formed on the component, which spring elements engage behind an upper end of the molded part.

7. The pull-out guide according to claim 6, wherein an elevation is formed on a housing of the component, which elevation protrudes into a groove in the upper end of the molded part in a mounted state of the component.

8. The pull-out guide according to claim 1, wherein the movable element is configured as a drawer.

9. A domestic appliance, including a drawer having pull-out guides, wherein one of the pull-out guides is configured as the pull-out guide of claim 1.

10. A pull-out guide of a movable element of a piece of furniture or a domestic appliance, the pull-out guide comprising:

a guide rail configured to be fixed to a body of the piece of furniture or domestic appliance;

a slide rail configured to be connected to the movable element;

the guide rail being detachably fixed to a molded part, the molded part being provided on the body;

a component configured to support movement of the movable element; and an activator arranged on the slide rail for controlling the component;

wherein the component is fixed to the molded part above both the guide rail and the slide rail perpendicularly to a pull-out direction of the pull-out guide;

wherein the activator engages from below into the component; and wherein two mutually facing spring elements are formed on the component, which spring elements engage behind an upper end of the molded part.

11. The pull-out guide according to claim 10, wherein the component is configured as one or both of an automatic retraction device and an ejection apparatus.

12. The pull-out guide according to claim 11 wherein the component is arranged with a damping device.

13. The pull-out guide according to claim 10, wherein the component is covered at least from above by a protective cover.

14. The pull out guide according to claim 10, wherein the activator is arranged integrally with an end stopper sealing a front face side of the slide rail.

15. The pull-out guide according to claim 10, wherein the component is latched onto the molded part.

16. The pull-out guide according to claim 10, wherein an elevation is formed on a housing of the component, which elevation protrudes into a groove in the upper end of the molded part in a mounted state of the component.

17. The pull-out guide according to claim 10, wherein the movable element is configured as a drawer.

18. A domestic appliance, including a drawer having pull-out guides, wherein one of the pull-out guides is configured as the pull-out guide of claim 10.

* * * * *